United States Patent [19]

Wilson

[11] 4,027,456

[45] June 7, 1977

[54] AIR-FREE POUCH PACKAGING METHOD

[75] Inventor: Donald C. Wilson, San Jose, Calif.

[73] Assignee: FMC Corporation, San Jose, Calif.

[22] Filed: Jan. 19, 1976

[21] Appl. No.: 650,347

[52] U.S. Cl. ..... 53/22 B; 53/11; 53/110; 53/112 B

[51] Int. Cl.² ..... B65B 31/04

[58] Field of Search ..... 53/22 A, 22 B, 110, 53/112 A, 112 B, 11

[56] References Cited

UNITED STATES PATENTS

| | | | |
|---|---|---|---|
| 2,311,707 | 2/1943 | Stewart | 53/110 |
| 2,649,671 | 8/1953 | Bartelt | 53/112 A X |
| 3,381,446 | 5/1968 | Marchand | 53/187 |
| 3,619,975 | 11/1971 | Johnson et al. | 53/110 X |

*Primary Examiner*—Travis S. McGehee
*Attorney, Agent, or Firm*—C. E. Tripp; A. J. Moore

[57] ABSTRACT

A method of packaging a substantially air-free product in an air-free pouch by first flattening and squeezing air from the pouch thereby reducing the pouch headspace prior to moving the pouch into a substantially air-free atmosphere. The pouch is then opened in the air-free atmosphere, is filled with an air-free product, is sealed within the air-free atmosphere, and is subsequently discharged therefrom. The opening of the pouch is aided, and additional air is purged from the pouch, by directing jets of high pressure air-free gas into the pouch during opening and filling of the pouch.

6 Claims, 14 Drawing Figures

20
SS
86
FS
F
OS
LS
90
P
46
44
42
196
294
292
282
280
296
278
274
276
26
272
270
28
34
30
36
32
38
40
24
22
290
178
132
48
50
52
54
56
69

HP
LP
P
F
SS
302
303
304
310
312
314
316
318
320
322
324
326
328
330
332
334
342
344
346
348
300
306
308
170
171
174
176
178
179
32
44
46
48
50
52
54
56
58
60
66
68
69
86
128
128a
130
130a
130b
132
137
138
146
252
254
256
258
260
262
264
266
268
269

AIR-FREE POUCH PACKAGING METHOD

CROSS REFERENCE TO RELATED APPLICATIONS

This application relates to the type of air purging method disclosed in Wilson et al. U.S. application Ser. No. 520,085 which was filed on Nov. 1, 1974 and is assigned to the assignee of the present invention.

This application also relates to the apparatus for excluding air from pouches as defined in Chiu et al. U.S. application Ser. No. 650,348, Wilson U.S. application Ser. No. 650,345, and Mencacci U.S. application Ser. No. 650,346; said applications being filed on even data herewith and assigned to the assignee of the present invention. The subject matter of these applications are incorporated by reference herein.

BACKGROUND OF THE INVENTION

1. Field of the Invention

This invention pertains to the pouch handling art and more particularly relates to a method of evacuating air from pouches and thereafter filling the pouches with a measured quantity of air-free material.

2. Description of the Prior Art

It is well known in the art to purge air and cooking gases from flexible containers or pouches having their upper ends closed, but not sealed, by moving the containers alternately through steam and water baths during processing thereby progressively forcing noncondensible gases out of the containers before sealing the containers. Wilson U.S. Pat. No. 3,501,318, which issued on Mar. 17, 1970, and is incorporated by reference herein discloses such a process.

Wilson U.S. Pat. No. 3,528,826 which issued on Sept. 15, 1970 discloses a similar system wherein closed but unsealed pouches are alternately moved into hot water and cold water troughs to first form steam within the containers and then condense the steam to progressively drive a steam-air mixture from within the container.

U.S. Pat. No. 1,920,539 which issued to White on Aug. 1, 1933 discloses a method wherein filled rigid containers, and separate caps, are passed through a steam zone at 212° F for the purpose of replacing the air in the headspace of the containers and around the caps with steam. While each cap is being sealed on a container, the container is said to be moved to a cooler zone so that the steam in the headspace condenses thereby reducing the internal pressure below atmospheric pressure.

U.S. Pat. No. 3,871,157 which issued to Domke et al. on Mar. 18, 1975, discloses a bag packaging apparatus wherein bags are severed from a film strip and are thereafter opened, filled and closed while moving through a hood that is divided into compartments. Each compartment is provided with means for independently adjusting the supply of protective gas directed into each compartment. After the bags have been closed they are moved out of the hood and are sealed while in an environment of air.

Johnson et al. U.S. Pat. No. 3,619,975 issued in the United States on Nov. 16, 1971, and discloses a pouch packaging machine which severs pouches from a strip of film at a point outside of a hood. The pouches are first opened while outside the hood with the aid of a splitting bar and a jet of gas such as nitrogen, and are thereafter advanced under a shallow hood having a non-oxidizing gas flowing therein. The pouch is thereafter again widely opened at the filling station by suction cups, is filled with an air-free product and is then advanced to a purging station. While at the purging station a tube is lowered through the product in the filled pouch and directs a non-oxidizing gas into the filled pouch to purge air therefrom. The pouch is subsequently sealed while its upper end is disposed under and aligned with a slot in the floor of the hood.

The present invention provides an improved method of packaging a product in a substantially air-free pouch while moving the pouch through a plurality of the processing stations in a tunnel. The method comprises the steps of receiving an empty pouch and maintaining the empty pouch in a closed condition; moving the closed pouch to a tunnel; maintaining an atmosphere of substantially air-free gas in the tunnel by inducing air-free gas to flow through the tunnel; opening the pouch when it is in the air-free gas atmosphere; closing the pouch after it has been opened in the air-free gas atmosphere by squeezing the side walls of the pouch together to thereby purge a mixture of air and the air-free gas from the pouch; thereafter again opening the pouch in said atmosphere; filling the pouch while in said atmosphere; sealing the pouch when in said atmosphere; and discharging the sealed pouch from said tunnel. Preferably, the walls of the pouch are squeezed together after opening the same in the air-free gas atmosphere by dunking the pouch in water. To remove even more headspace air from the pouch, a jet of air-free gas at superatmospheric pressure may be directed into the pouch during the filling of the pouch.

The pouch packaging method of the present invention may comprise the initial steps of receiving an empty pouch and maintaining the empty pouch in a closed condition; applying pressure to the pouch prior to moving the pouch into the air-free gas atmosphere for the purpose of flattening the pouch and squeezing any headspace air out of the pouch; applying a vacuum about the pouch while the pressure is being applied to the pouch to flatten the pouch; and then moving the closed, flattened pouch into the tunnel.

DESCRIPTION OF THE PREFERRED EMBODIMENT

Figures 1, 3:
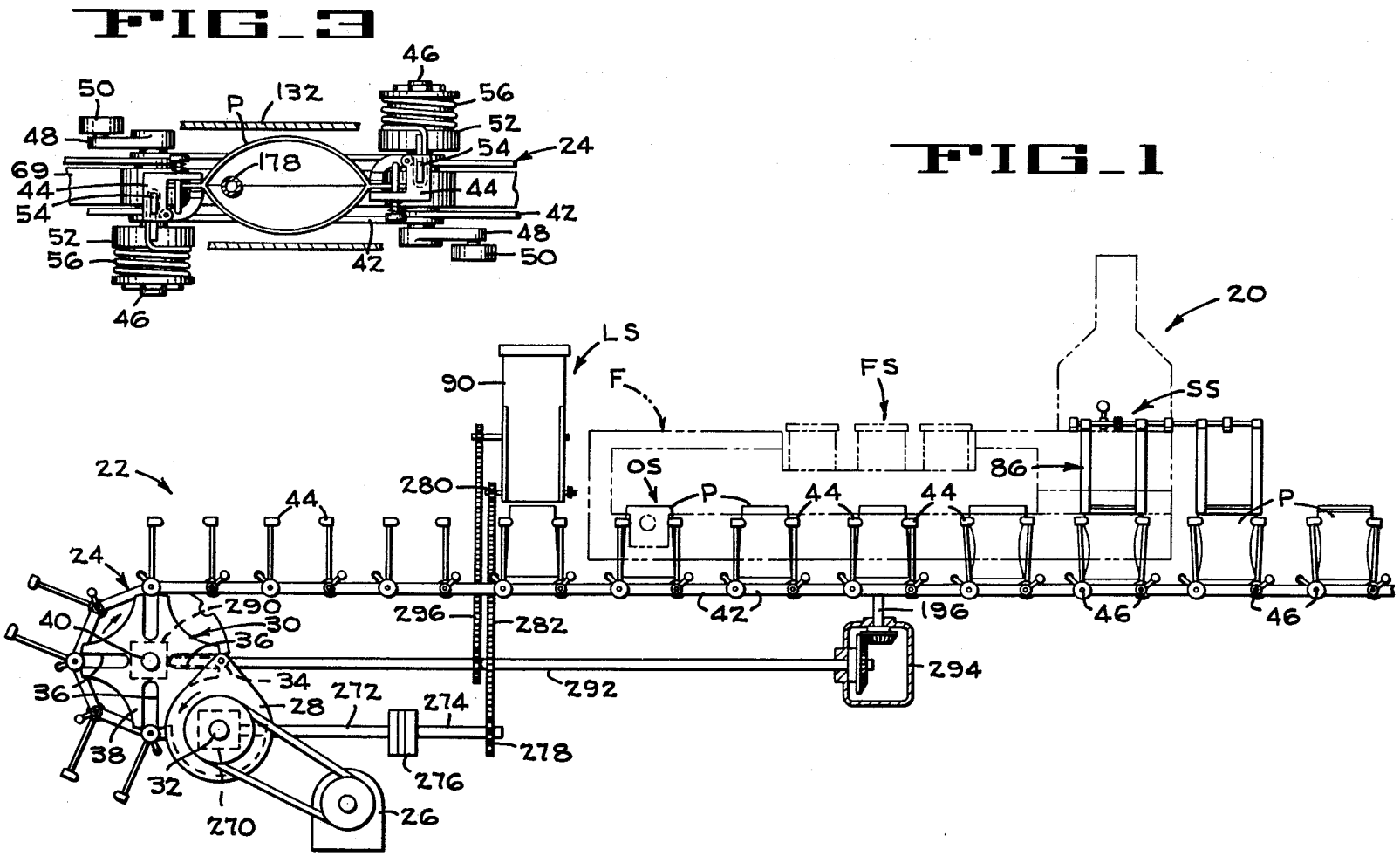
FIG. 1 is a diagrammatic elevation of a portion of the machine for filling and sealing pouches with the air excluding method of the present invention incorporated therein.
FIG. 3 is an enlarged horizontal section taken along lines 3—3 of FIG. 2 illustrating the mechanism for supporting a pouch while moving the pouch through the handling components of FIG. 2.

The air exclusion and pouch filling method of the present invention is performed by an apparatus 20 (FIG. 1) that is illustrated as being components of a single lane pouch handling machine 22 which processes flexible containers or pouches P. Each pouch P is preferably formed from a thermosealing material with three sides sealed and with its upper end (FIG. 1) unsealed and adapted to be opened.

The machine 22 includes an endless conveyor 24 that is intermittently driven by a motor 26 connected to the driving element 28 of a standard well known Geneva drive 30. The driving element 28 is keyed to a continuously driven shaft 32 and includes a cam follower 34 which rides in grooves 36 of a driven element 38 of the Geneva drive. The driven element 38 is keyed to the drive shaft 40 of the conveyor 24 and indexes the conveyor 24 in 90° increments, which in the preferred embodiment moves the conveyor in increments equal to the length of two links 42 of the conveyor 24 and at a rate of between 15–40 containers per minute depending upon the time required for sealing the pouches P.

Figure 5:
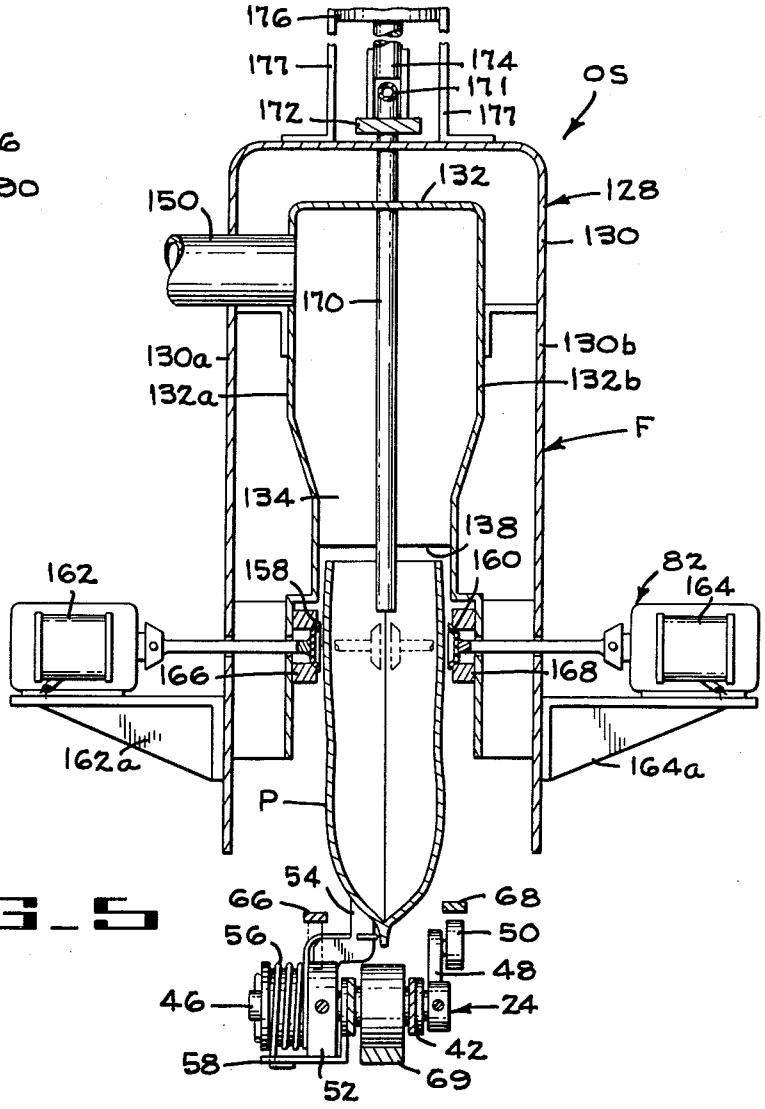
FIG. 5 is an enlarged vertical transverse section taken along lines 5—5 of FIG. 2 illustrating a device for opening the pouch after the pouch has been moved into a stream atmosphere.

In order to support the pouches P on the conveyor 24, every second link includes a pair of pouch clamping devices 44 that are identical but oriented on opposite sides of the conveyor as clearly illustrated in FIG. 3. Each device 44 includes a pivot pin 46 (FIGS. 2, 3 and 9) journaled in a sleeve that pivotally connects one link to the adjacent link. A lever 48 having a cam follower 50 journaled thereon is secured to one end of the pin 46, and a hub 52 having an elongated upwardly extending spring finger 54 rigid therewith is secured to the pivot pin 46 on the other side of the conveyor 24. A torsion spring 56 is connected between the hub 52 and an outwardly bent ear 58 (FIGS. 9 and 10) of the adjacent conveyor link and is held in position around the cylindrical portion of the hub 52 by a washer and cotter pin. As best illustrated in FIGS. 3 and 5, the torsion springs 56 of adjacent devices 44 urge the spring fingers 54 toward each other to normally hold the supported pouches P in an open position. An abutment stop 60 (FIGS. 2, 9 and 10) on each hub 52 engages the associated link ear 58 to limit the amount of inward pivotal movement of the spring fingers 54.

One of the pouch clamping devices 44 (FIG. 3) is rigidly secured near the upper end of each spring finger 54 for firm clamping engagement with the associated pouch. The clamping devices 44 are diagrammatically illustrated herein but are preferably of the type disclosed and claimed in Wilson U.S. Pat. No. 3,763,524 which issued on Oct. 9, 1973 and is assigned to the assignee of the present invention. The disclosure of this Wilson patent is incorporated herein by reference.

Figure 2:
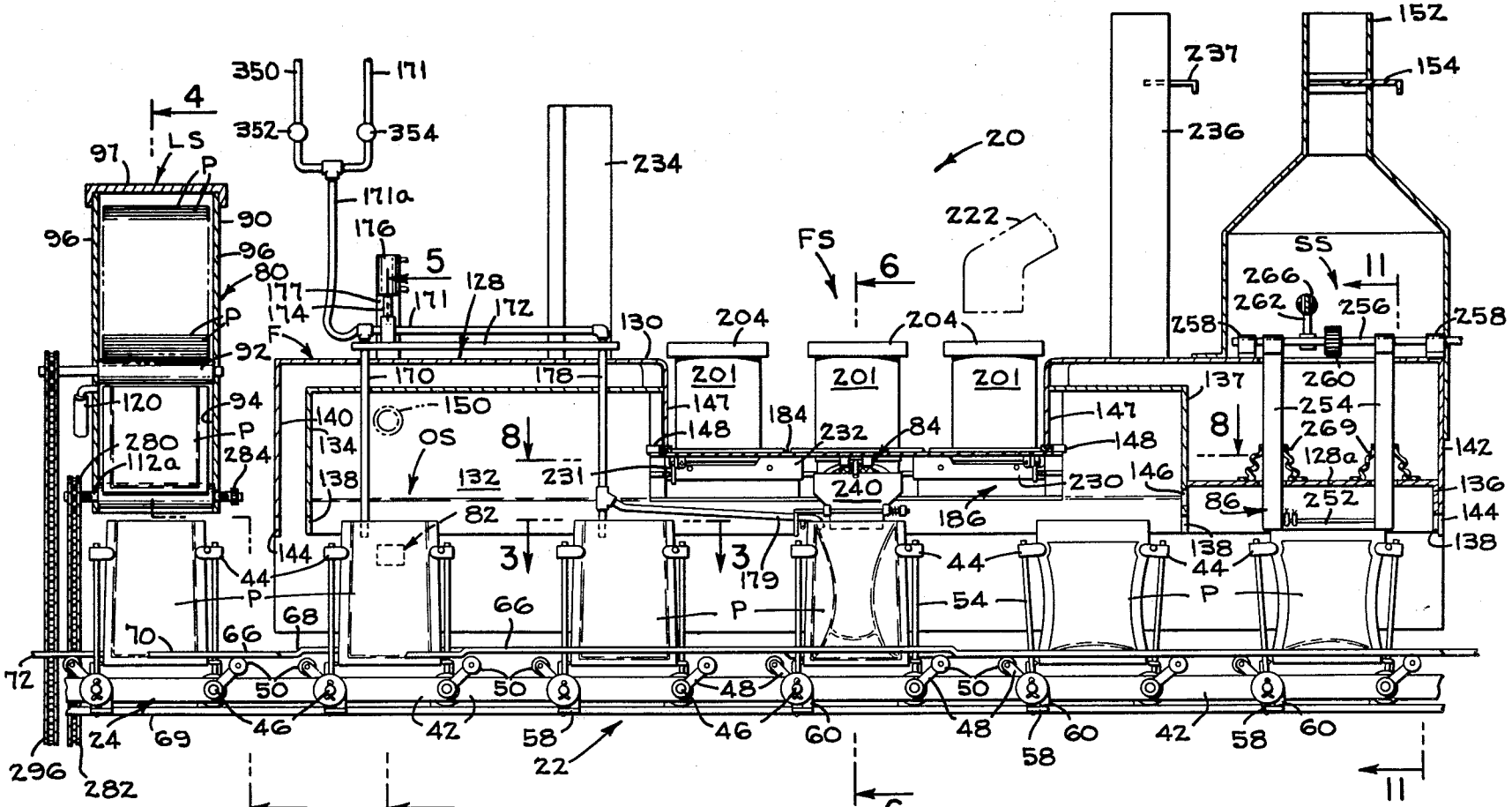
FIG. 2 is an enlarged vertical longitudinal section through the pouch handling components of the apparatus.
Figure 4:
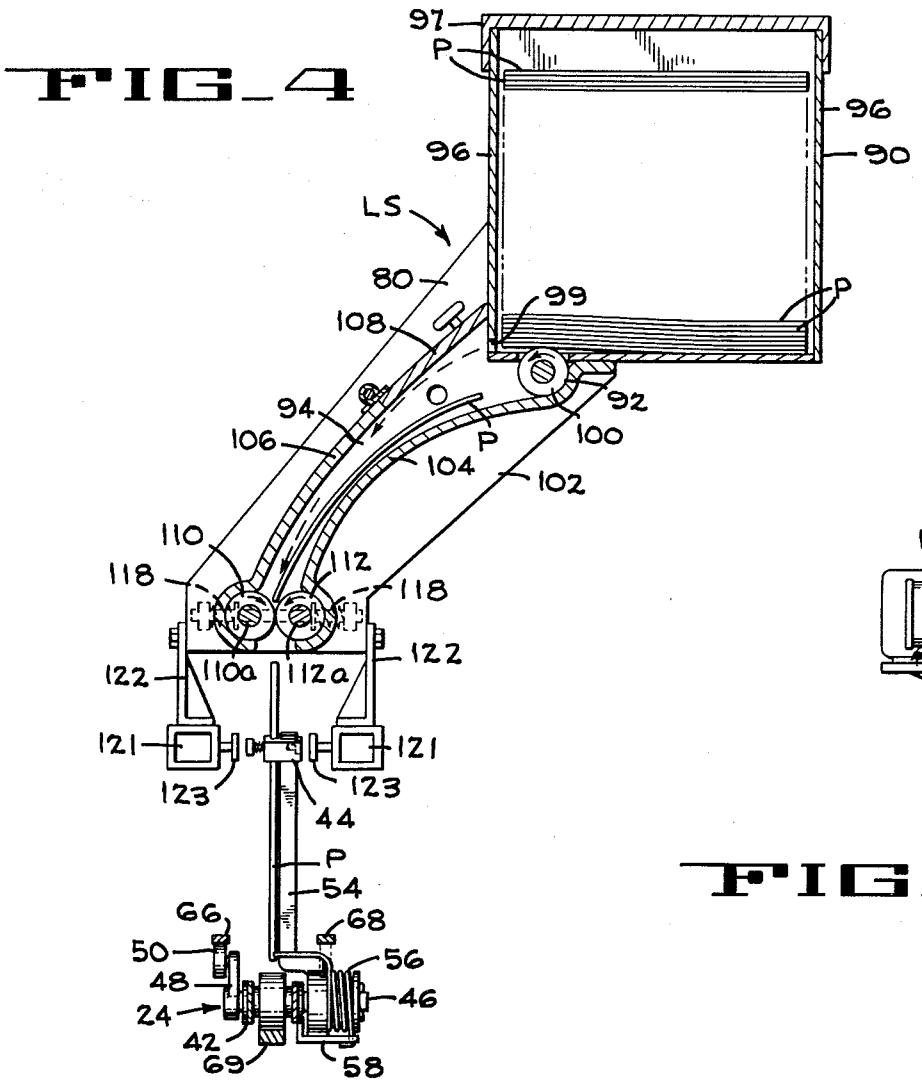
FIG. 4 is an enlarged vertical transverse section taken along lines 4—4 of FIG. 2 illustrating a pouch feeding mechanism.
Figure 6:
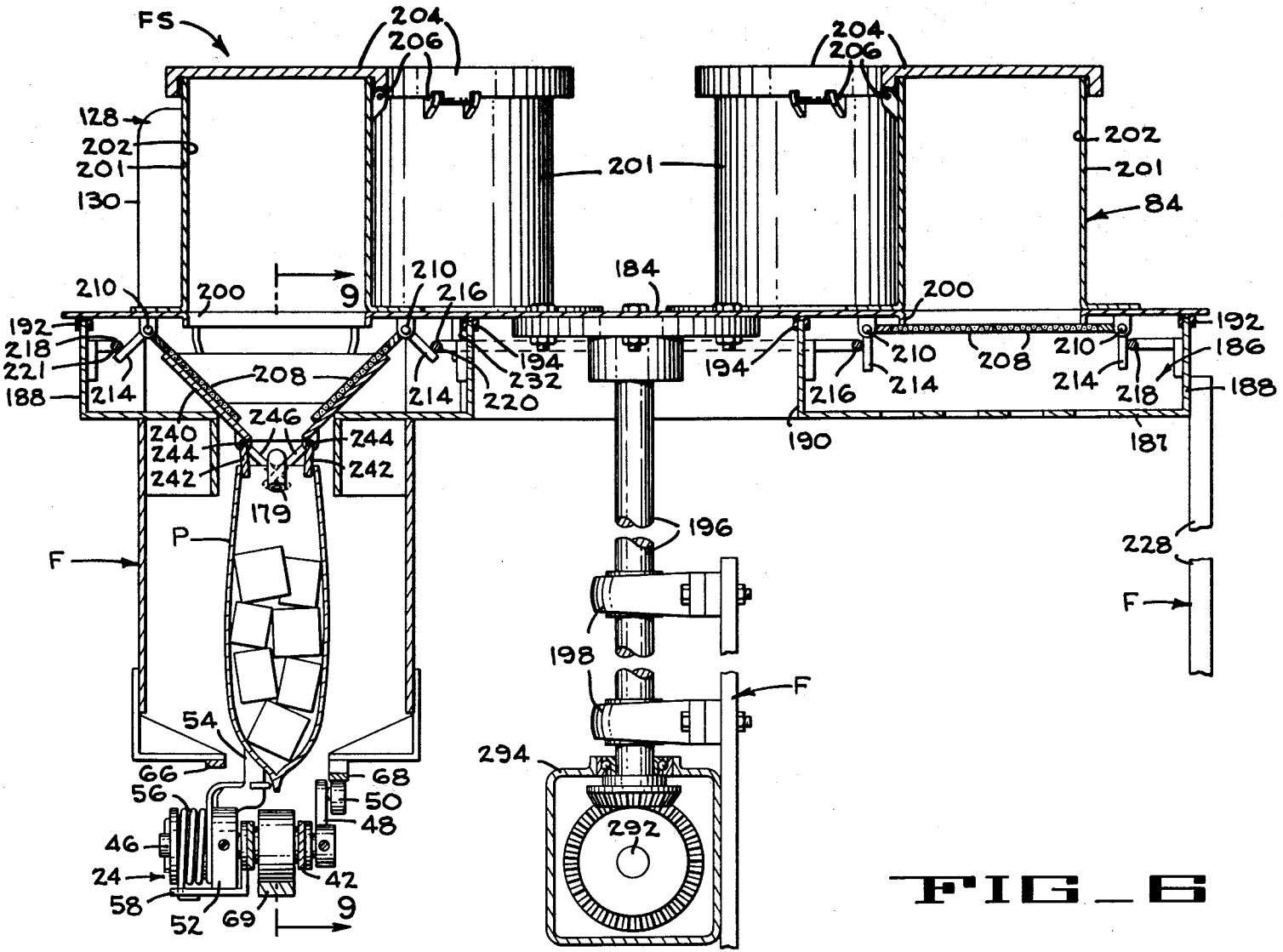
FIG. 6 is an enlarged vertical transverse section taken along lines 6—6 of FIG. 2 illustrating a rotary pouch filling mechanism.
Figure 7:
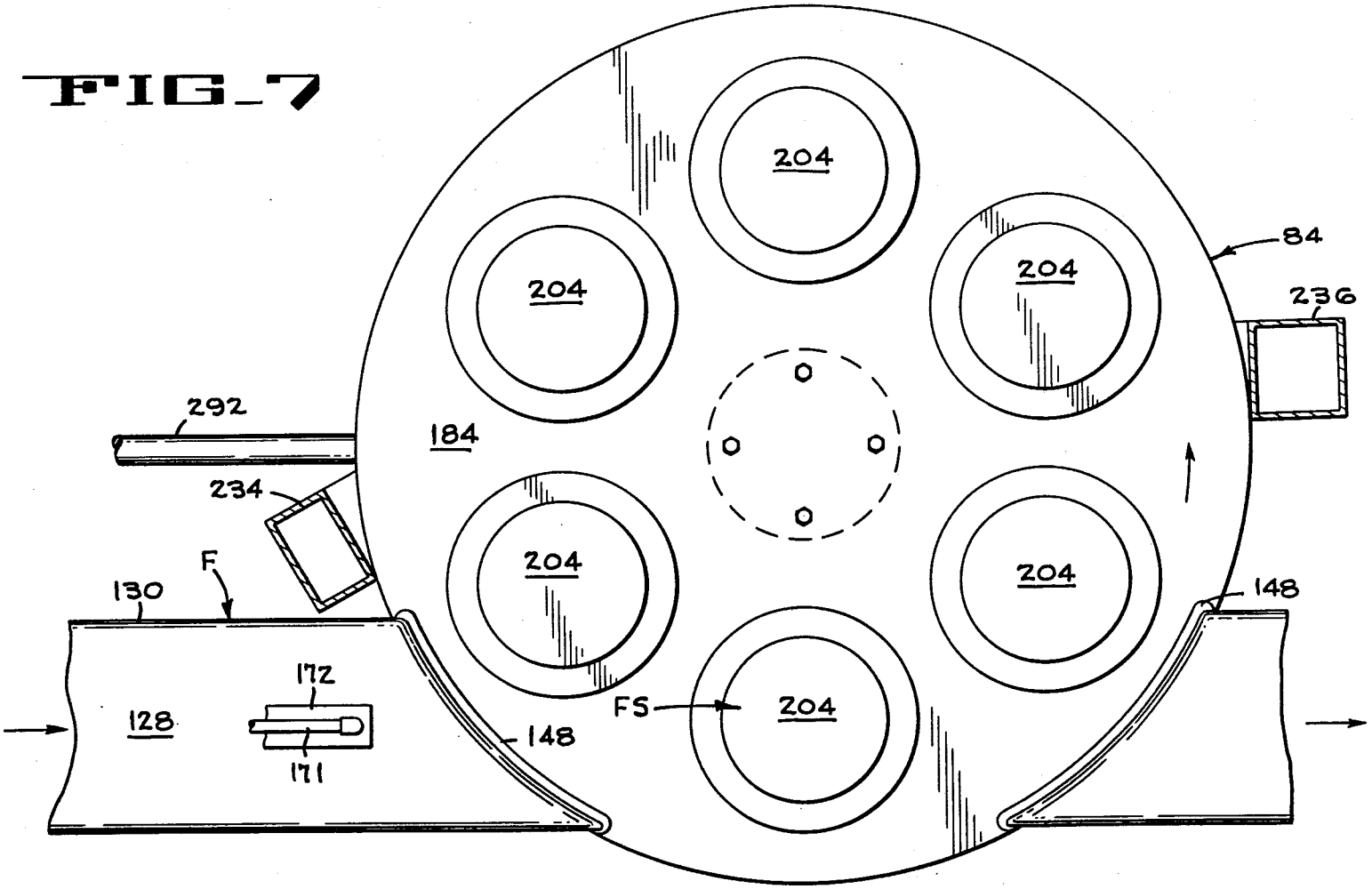
FIG. 7 is a plan of the filling mechanism of FIGS. 2 and 6.
Figures 11, 12:
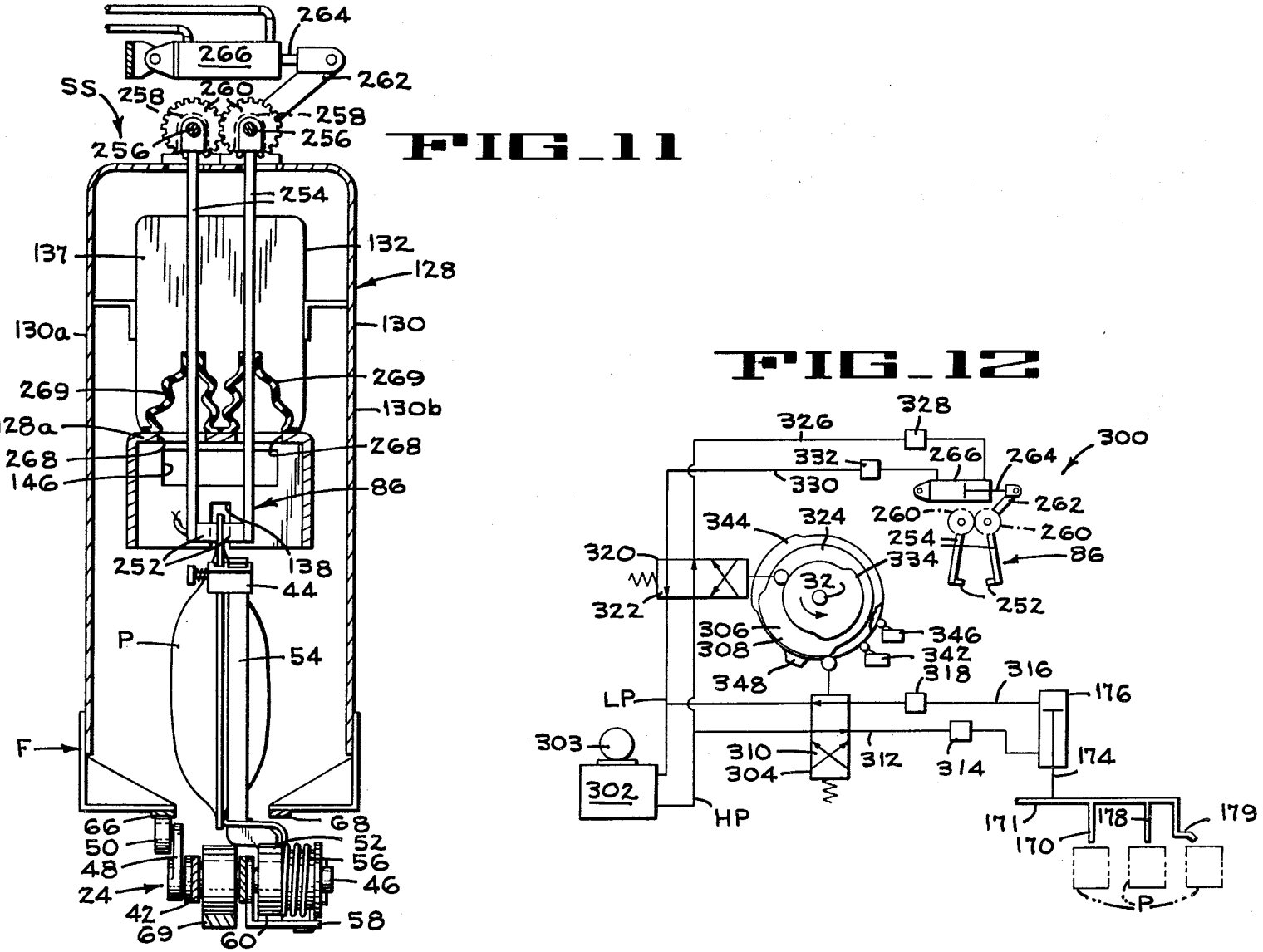
FIG. 11 is an enlarged vertical section taken along lines 11—11 of FIG. 2 illustrating a pouch sealing mechanism.
FIG. 12 is a hydraulic control diagram for operating the several components of the apparatus in timed relation.

As illustrated in FIGS. 2 and 11, spaced cam tracks 66 and 68 are fixed to the frame F of the machine 22 on opposite sides of the centerline of the conveyor 24, which rides along a central track 69 (FIGS. 4 and 5). The inlet ends 70 and 72 (FIG. 2) of the track 66 and 68 are positioned immediately upstream of the pouch loading station LS so that movement into the station will cause the cam followers 50 to engage the associated tracks 66 and 68 and urge the spring fingers 54 to an intermediate position which permits gripping of the closed pouch. Immediately upon moving away from the loading station LS, the cam followers 50 engage slightly lower portions (not illustrated) of the tracks 66,68 causing the spring fingers 54 to apply a tensioning or pouch closing force to the mouth of the pouch and to retain such tensioning force until the mouth of the pouch is moved into a steam atmosphere as will be made apparent hereinafter.

As illustrated in FIG. 2, the air exclusion and pouch filling apparatus 20 of the present invention includes the pouch loading station LS with a pouch loading mechanism 80 therein; a pouch opening station OS having a pouch opening mechanism 82 therein; a pouch filling station FS having a pouch filling mechanism 84 therein; and a pouch sealing station SS having a sealing mechanism 86 therein. Thereafter the filled and sealed pouch may be released from the conveyor 24 onto any suitable take-away means (not shown).

No structure has been illustrated for automatically opening and closing the clamping devices 44 as diagrammatically illustrated in the drawings. It will be understood, however, that in the preferred embodiment the clamping devices and carriers disclosed in the aforementioned Wilson U.S. Pat. No. 3,763,524 will be used and such clamping devices may be automatically opened by cam tracks or properly timed solenoids if desired.

The pouch loading mechanism 80 (FIGS. 2 and 4) as diagrammatically illustrated includes a magazine 90 and an individual pouch feed device 92 disposed within a vacuum chamber 94. The magazine 90 includes four walls 96, a cover 97, and a floor 98 with a narrow slot 99 provided in one of the walls to allow one pouch at a time to be fed therethrough. An intermittently driven feed roller 100 having a resilient surface is closely fitted in and projects through a slot in the floor 98 of the magazine for engaging and advancing one pouch at a time from the magazine into the vacuum chamber 94 when the conveyor 24 is in motion. It will be appreciated that the weight of the stack of pouches in the magazine resting upon the lowermost pouch causes the feed roller 100 to progressively squeeze air out of the open trailing end of the pouch as the pouch is fed into the vacuum chamber 94. If desired, a clutch-brake assembly (not shown) controlled by an electric eye may be placed on the shaft 100 to assure that one and only one pouch is fed into the vacuum chamber 94 for each intermittent motion of the conveyor 24.

The vacuum chamber 94 includes sidewalls 102 to which are secured a lower pouch guiding wall 104 and an upper pouch guiding wall 106 having a pivoted access door 108 therein. A pair of intermittently driven pinch rolls 110,112 resilient surfaces are journaled in bearings which are urged toward each other by springs 118. The bearing blocks are connected to associated sidewalls 102, and the pinch rolls 110,112 are closely fitted therein and to arcuate portions of the pouch guide walls 104 and 106. A vacuum source (not shown) is connected to the vacuum chamber 94 by a vacuum pipe 120 thus evacuating air from the chamber 94.

After a pair of pouch clamping devices 44 of the conveyor 24 have been indexed into pouch receiving position below the pouch loading station LS, the pinch rolls 110, 112 aided by the low pressure atmosphere in the vacuum chamber 94, applies a firm squeezing pressure to the pouch thus progressively squeezing substantially all of the air out of the upper open end of the pouch. The evacuated pouch then gravitates downwardly between two of the clamping devices 44 which are opened at this time either manually or by mechanism such as a pair of solenoids 121 (FIG. 4) secured to the vacuum chamber 94 brackets 122. The solenoids 121 include plates 123 positioned to engage and open the associated clamping devices 44 at the loading station LS when energized. During this time the clamping devices 44 are maintained in position to receive the pouch by the aforementioned intermediate height portions 70,72 (FIG. 2) of the tracks 66,68. Upon indexing of the conveyor 24 to the next station, low portions of the tracks 66,68 cause the clamping device 4 to apply a firm stretching force on the upper end of the pouch to prevent any air from entering the pouch by forming a one-way valve therein. The conveyor 24 then advances the pouch into a pouch steam tunnel 128 (FIGS. 2 and 5).

The steam tunnel 128 includes an outer housing 130 having sidewalls 130*a*,130*b;* and an inner housing 132 having side walls 132*a*,132*b*. Both housings have open lower ends with the lower end of the outer housing projecting downwardly to a point near the bottom of the pouch whereas the open end of the inner housing 132 projects downwardly only to a point below the upper end or mouth of the pouch. End walls 134,136 and intermediate wall 137 of the inner housing 132 are slotted at 138 to permit the upper end of the pouch to be conveyed therethrough. The outer housing 130 likewise includes end walls 140,142 which are slotted at 144 to permit passage of the pouch therethrough. As indicated in FIGS. 2 and 11, the portion of the inner steam tunnel at the sealing station SS is reduced in height at 128a and the wall 137 is apertured at 146 to permit a flow of steam therethrough. Also, that portion of the steam tunnel 128 at the filling station FS is reduced in height as indicated by transverse walls 147 that are sealed to the upper rotatable surface of the filling mechanism 84 by resilient U-shaped seals 148.

Low pressure steam from a source (not shown) is reheated immediately adjacent the steam tunnel 128 to at least 212° F for distribution through conduit 150 (FIG. 5) at atmospheric pressure into the upstream end of the inner housing 132 of the steam tunnel 128. This atmospheric steam flows downsteam through the tunnel and also out of the lower open end of the inner housing 132 into the outer housing 130 to minimize the formation of condensate and for subsequent discharge through a stack 152 (FIG. 2) having an adjustable slide valve 154 therein. Thus, the upper end or mouth of the pouch P is disposed in an atmosphere of steam from the time the pouch enters the steam tunnel 128 until the pouch is sealed at the sealing station SS.

After the conveyor 24 has moved the pouch into the steam tunnel 128 and into the pouch opening station OS, the tracks 66,68 release the cam followers or rollers 50 allowing the clamping devices 44 to move toward each other to their open pouch positions. In order to positively open the pouch P, a pair of opposed generally rectangular suction cups 158,160 of the pouch opening mechanism 82 are slidably mounted in the walls 130*a*, 132*a;* 130*b*,132*b* of the steam tunnel 128 and are actuated by solenoids 162,164 or the like supported by brackets 162*a*,164*a* secured to the outer walls 130*a*, 130*b* of the steam tunnel. A pair of suction breaking rings 166,168 are secured to the walls of the inner housing 132 and break suction by deforming the rectangular suction cups when the solenoids are deactivated to move the cups to their normal outer pouch opening positions illustrated in solid lines in FIG. 5.

In order to assist the opening of pouch P and to purge air therefrom, a steam nozzle 170 directs high pressure steam into the pouch at the pouch opening station OS. The nozzle is connected to a source of high pressure steam (not shown) by a valved conduit 171 that includes a flexible portion 171*a* (FIG. 2). The steam nozzle 170 is preferably mounted on a horizontal bar 172 that is connected to the piston rod 174 of a pneumatic power cylinder 176 that is mounted on the frame F by a bracket 177. A second stream nozzle 178 and third steam nozzle 179 are connected to the conduit 171 and bar 172 for directing high pressure steam into the pouch when at an intermediate station and the filling station FS, respectively. The power cylinder 176 is retracted to raise the steam nozzles 170,178,179 above the pouches when the pouches are being moved from station to station, and are lowered to enter the pouches when the pouches are indexed at the above mentioned stations. It will be understood that the high pressure steam from the steam nozzle 170 not only aids in opening the pouch but also fills the pouch with steam and purges additional air therefrom.

After being opened, the pouch is advanced to and is indexed in the filling station FS. Although many different types of products may be filled into the pouch, the particular filling mechanism 84 illustrated in FIGS. 2 and 6–10 is designed to handle and purge air from a particulate or chunky food product such as diced vegetables or french fried potatoes.

The filling mechanism 84 includes a rotary table 184 (FIG. 6) that is rotatable in a counterclockwise direction (FIG. 7) over a stationary annular product steam chamber 186 which includes a perforated or open floor 187. The steam chamber 186 includes an outer annular wall 188 and an inner annular wall 190 that are sealed to the table 184 by U-shaped rubber seals 192,194. The rotating table 184 is secured to a vertical shaft 196 journaled by bearings 198 to the frame F. A plurality of evenly spaced openings 200, six openings being provided in the preferred embodiment, are formed in the table 184; and a tubular housing 201 defining a product degassing chamber or pocket 202 is secured to the table over each hole. Each pocket 202 has a cover 204 connected thereto for pivotal movement about an associated pivot pin 206.

Each pocket 202 has a pair of perforated doors 208 (FIGS. 6 and 8) pivoted therebelow about pivot pins 210. The doors 208 each include a cam lever 214 which rides along either an inner cam ring 216 or an outer cam ring 218. Each cam ring 216,218 has a configuration which normally maintains the doors in a closed position, but includes lobes 220,221 respectively which open the doors to discharge the product only when the doors are indexed over a pouch to be filled in the filling station FS. The cam rings 216 and 218 are secured by suitable brackets to the annular inner wall 190 and outer wall 188, respectively, of the steam tunnel 186. The pockets 202 are filled with a measured quantity of product either manually or by any well known type of feeder 222 (FIG. 2).

Figure 8:
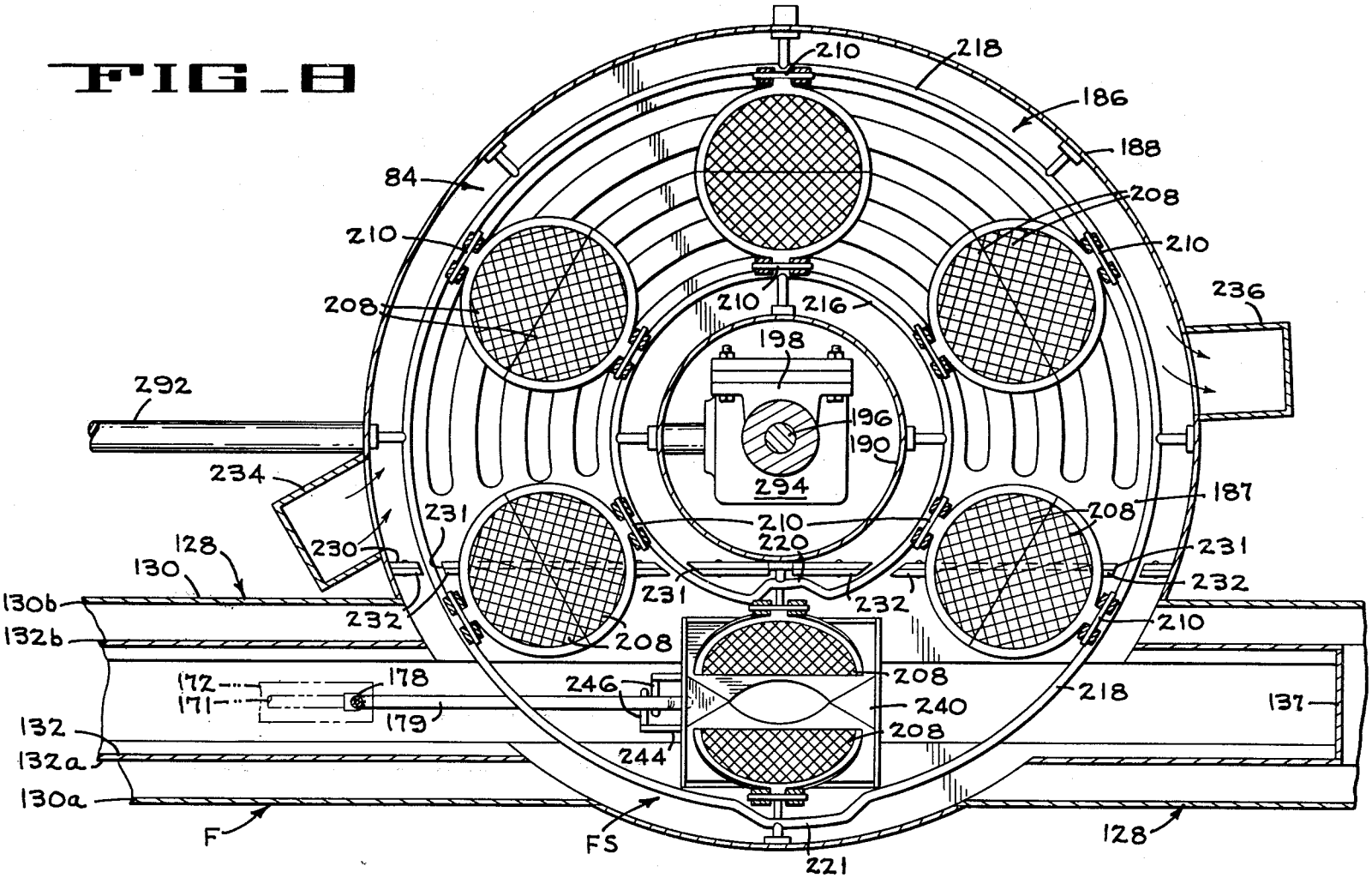
FIG. 8 is a horizontal section taken along lines 8—8 of FIG. 2 through a gas purging chamber of the pouch filling mechanism.

The product steam chamber 186 is rigidly secured to a foreshortened portion of the inner and outer housing walls 132*a*,132*b*,130*a*,130*b* of the pouch steam tunnel 128. One or more legs 228 secured to the outer wall 188 also aid in supporting the product steam chamber 186. As best shown in FIG. 8, a baffle 230 is provided in the product steam chamber 186 and is disposed parallel to the conveyor 24 to aid in guiding the flow of steam in the pouch steam tunnel 128 from the inlet end to the outlet end of the tunnel 128 as previously described. The baffle 230 is notched at 231 to permit passage of the cam levers 214 and includes a rubber flap 232 which bears against the rotating table 184 to aid in guiding a counterflow of steam (or another air purging medium) relative to the direction of movements of the pockets 202. Steam at atmospheric pressure flows through the product steam chamber 186 from the inlet conduit 234 to a discharge stack 236 provided with an adjustable vent valve 237 (FIG. 2) therein.

The steam entering the conduit 234 is heated to at least 212° F by a steam heater (not shown) immediately adjacent the conduit 234 and flows in a clockwise direction through the product steam chamber 186 (FIG. 8). The counterflowing steam raises through the perforated doors 208 into the product filled pockets 202 thereby displacing the heavier air entrapped within the voids between pieces of product in the several pockets 202. The heavier air either gravitates downwardly and out of the perforated floor 187 of the product steam chamber 186 or is moved with the flowing steam through the stack 236.

Figure 10:
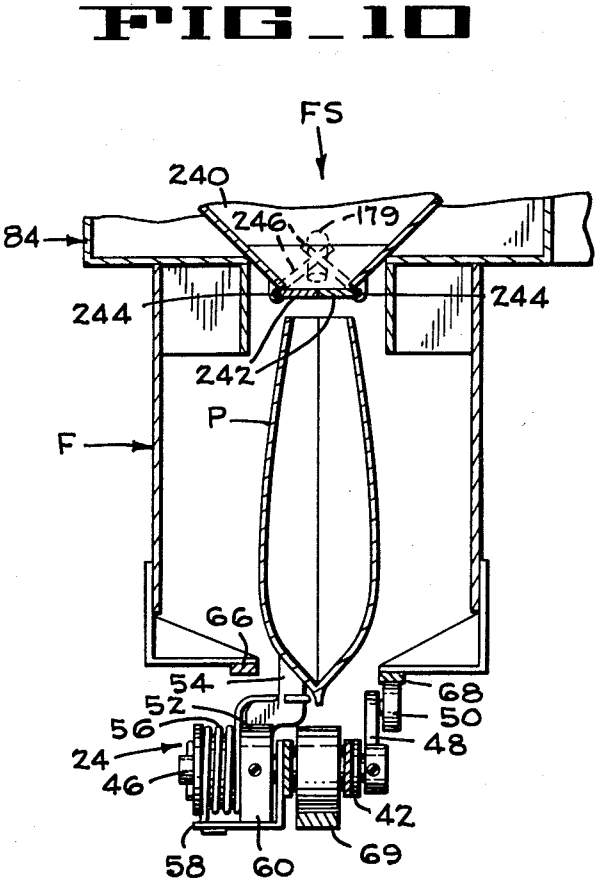
FIG. 10 is a section taken along lines 10—10 of FIG. 9.
Figure 9:
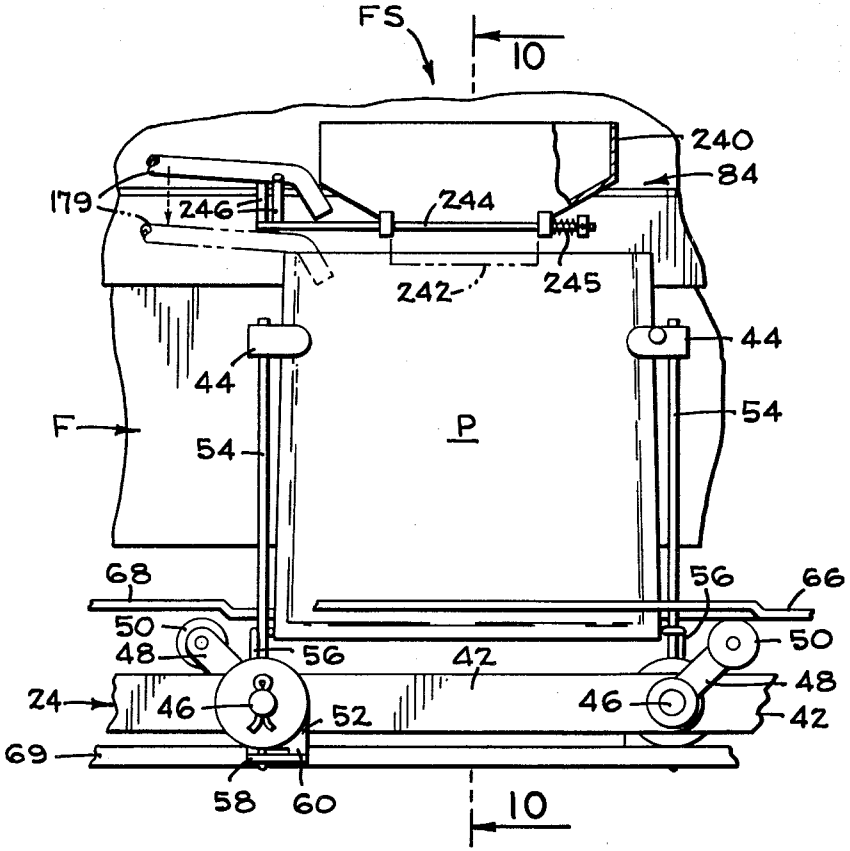
FIG. 9 is an enlarged longitudinal section taken along lines 9—9 of FIG. 6 illustrating a loading chute and its gate in two operative positions.

Each pocket 202 having the air-free product therein is then advanced into the filling position over an open, air-free pouch P. As the pocket enters the filling station FS, the lobes 220,221 of the cam rings 216,218 allow the doors 208 to open thereby dumping the air-free product into a pouch shaped or generally elliptical funnel 240 (FIGS. 9 and 10). A pair of gates 242 are connected to pivot shafts 244 journaled on the funnel 240. The gates 242 are biased by springs 245 to the closed position and have fingers 246 secured to the shafts 244 and positioned below a horizontal portion of the steam nozzle 179. The steam nozzle 179 is secured to the previously mentioned vertically reciprocable horizontal bar 172 (FIG. 2) and communicates with the high pressure steam conduit 171. Thus, when the bar 172 and nozzle 179 are in their raised positions, the gates 242 will be closed and both the nozzle and the gates will be disposed above the path of movement of the pouches P, as indicated in FIGS. 9 and 10. When the power cylinder 176 is activated to lower the steam nozzle 179, the horizontal portion of the nozzle will contact the fingers 246 thereby opening the gates 242 and discharging the air-free product into the air free pouch P. The open gates also enter the pouch thereby guiding the product into the pouch, and assuring that the pouch walls are spaced apart so that articles such as french fried potatoes will not droop over one wall of the pouch making it impossible to properly seal the pouch. During filling of the pouch, a high pressure jet of steam is directed into the pouch through the nozzle 179 thereby further assuring that any air in the pouch or product will be purged therefrom.

After the pouch has been filled, the conveyor 24 moves the pouch to the sealing station SS (FIGS. 2 and 11) during which time the cam track 66,68 firmly engage the rollers 50 to cause the clamps 44 to apply a tensioning force across the unsealed upper end of the pouch thereby forming a one-way valve preventing any air from entering the pouch. With the pouch at the sealing station SS, the sealing mechanism 86 is activated to hermetically seal the upper end of the pouch.

The sealing mechanism 86 (FIGS. 2 and 11) is a conventional heat sealer and includes a pair of jaws 252 supported by arms 254 secured to shafts 256. The shafts 256 are journaled by bearings 258 secured to the frame F and have meshing pinion gears 260 keyed thereto. A lever 262 is rigidly secured to one of the shafts and is pivotally connected to the piston rod 264 of a fluid cylinder 266 that is pivoted to a portion of the frame F. Retraction of the piston rod 264 separates the jaws 252 from each other, while extension of the piston rod applies a sealing pressure of about 40 pounds per square inch to the seal area for about 0.5 seconds at a temperature of about 400°–500° F. Apertures 268 are provided in the roof of the extension tunnel 128*a* and bellow-type diaphragms 269 are provided to permit the arms 254 to operate within the steam filled tunnel extension 128*a*.

The filled and sealed air-free pouch P is then advanced by the conveyor 24 out of the steam tunnel 128, the clamping devices 44 are opened by solenoids similar to solenoids 121 (FIG. 4), and the sealed pouch is discharged from the machine 22 onto any suitable takeaway means (not shown) during which time the containers are cooled.

The several above described components of the pouch handling machine 22 must, of course, be operated in timed relation with each other. In this regard, the pinch rolls 110,112 (FIGS. 1, 2 and 4) of the pouch loading mechanism 80 receives their power from the Geneva drive shaft 32 (FIG. 1). The drive shaft 32 transmits power through a right angle gear box 270, a pair of aligned shafts 272,274 having a clutch-brake assembly 276 therebetween and a drive sprocket 278 keyed to the shaft 274. The sprocket 278 is connected to a sprocket 280 (FIG. 2) secured to the shaft 112*a* of the pinch roll 112 by a chain drive 282. A pair of meshing spur gears 284 (only one being shown in FIG. 2) are keyed to the shafts 110*a* and 112*a* and are effective to drive both pinch rolls 110,112 at the same speed but in opposite directions to move a pouch downwardly into the open pouch clamping devices 44 of conveyor 24 disposed therebelow.

The clutch-brake assembly 276 is of any well known design and may be a Model 500 manufactured by Warner Electric. The clutch of the clutch-brake assembly is actuated and the brake is deactivated to drive the pinch rolls 110 and 112 when the conveyor 24 is stationary; and the clutch of the clutch-brake assembly is deactivated and the brake is activated when the conveyor 24 is moving. Such activation and deactivation is accomplished by a switching mechanism to be described hereinafter.

The feed roller 100 (FIGS. 2 and 4) of the pouch loading mechanism 80, and the rotary table 184 of the filling mechanism 84 are driven from the drive shaft 40 (FIG. 1) through a 1:1 right angle gear box 290 which connects the shaft 40 to a suitably journaled line shaft 292 and a second right angle gear box 294 (FIGS. 1 and 6) with a 3:2 gear ratio that connects the line shaft 292 to the filler shaft 196. A chain drive 296 connects the line shaft 292 to the feed roller 100 and has a sprocket ratio sufficient to remove one pouch from the magazine 90 during each intermittent motion of the line shaft 292.

The position of the steam nozzles 170,178 and 179, and the sealing mechanism 86, may be controlled by any suitable system such as a hydraulic or pneumatic system. A typical hydraulic control system 300 is illustrated in FIG. 12 for controlling the movement of the high pressure steam nozzles, and for operating the sealing mechanism 86. The components of FIG. 12 are positioned as they would appear Just as the conveyor 24 begins to move to the next station.

The hydraulic control system 300 includes a pump 302 which is driven by a motor 303 to direct high presure fluid through main high pressure conduit HP and to receive the low pressure fluid from conduit LP. A steam nozzle control valve 304 is actuated by a cam 306 which is secured to the Geneva drive shaft 32 and includes a lobe 308 that extends over an arcuate range of slightly in excess of 90°. When positioned on the lobe 308 as indicated in FIG. 12, fluid flows through parallel passages in the core 310 of valve 304 in the direction indicated by the arrows. High pressure fluid flows through a conduit 312 and speed control valve 314 into the cylinder 176 thus raising the nozzles 170, 178 and 179. Low pressure fluid returns to the pump 302 through conduit 316, speed control valve 318, valve 304 and low pressure conduit LP.

When the valve core 310 has moved off the lobe 308, the fluid reverses its direction of movement by flowing through cross passages formed in the periphery of the core 310 thus lowering the nozzles into the now stationary pouches P. Similarly the hydraulic cylinder 266 of the sealing mechanism 86 is controlled by a valve 320 that includes a core 322 having parallel passages and cross passages therein. The core 322 is shifted by a cam 324 secured to the shaft 32 and disposed in a plane spaced from the cam 306. The cam 324 includes a small diameter portion which maintains the core 322 in its parallel passage position until after the conveyor 24 has stopped movement. During this time, high pressure fluid is directed through conduit 326 and speed control valve 328 to retract the piston 264 in the cylinder 266 thereby opening the sealing jaws. Low pressure fluid is returned to the pump 302 through conduit 330, speed control valve 332, the valve 320 and low pressure line LP.

The cam 324 also includes a lobe 334 which shifts the valve core 322 to the cross passage position shortly after conveyor 24 has stopped thereby reversing the direction of flow of fluid to the cylinder 266 and closing of the sealing jaws. The lobe 334 extends through an arcuate range sufficient to maintain sealing pressure on the containers for the desired sealing time.

Actuation of a double pole switch 342 energizes the solenoids 121 (FIG. 4) which open the clamping devices at the loading station LS and similar solenoids (not shown) at the discharge station. The switch 342 also energizes the clutch of the clutch brake assembly 276 and de-energizes the brake. Closing of the switch 342 by a cam 344 drives the pinch rolls 110,112 to advance the pouch into the open pouch clamping devices 44 positioned therebelow shortly after the conveyor 24 has stopped. Shortly thereafter the suction cups 158,160 are moved inwardly to grip the pouch walls upon momentary closing of a switch 346 by a cam lobe 348 disposed in a plane spaced from the planes of the other cams and which energizes solenoids 162,164. It will be noted that the switch 346 effects engagement and opening of the pouch shortly before the valve core 310 is moved to the cross-passage position which lowers the high pressure steam nozzles 170,178 and 179 into the open pouches P therebelow.

Although the operation of the several components of the pouch handling machine 22 has been included with the description of the several components of the machine, a brief summary of the operation will be given in connection with the FIGS. 13A and 13B having special regard to the amount of headspace and the volume of air in the pouch at the different stages in the pouch evacuating, filling and sealing operation.

Figures 13A, 13B:
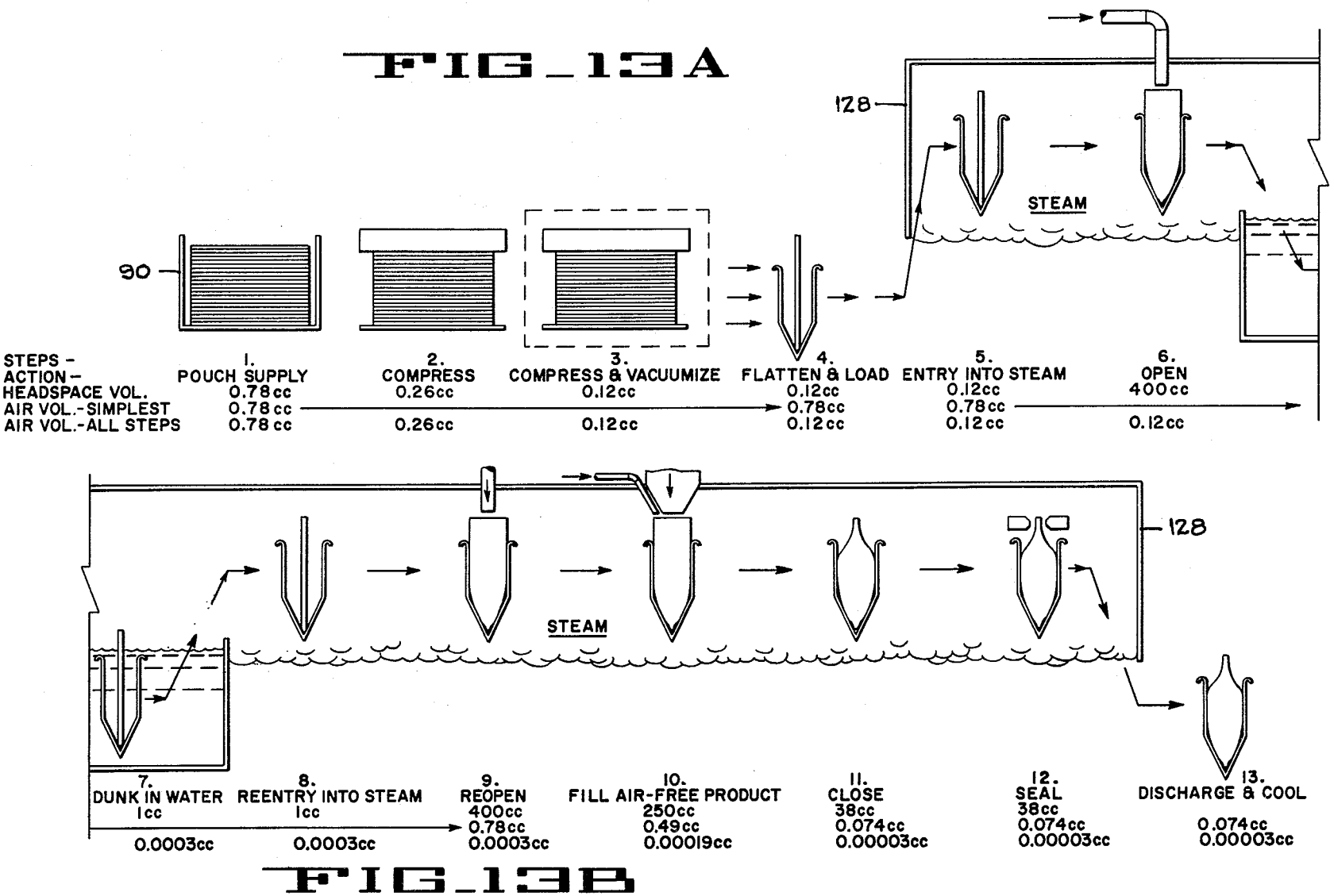
FIGS. 13A and 13B when combined constitutes a diagram illustrating the approximate volume of headspace and of air in the pouch at different operating stations of the air exclusion and pouch filling apparatus of the present invention.

It will be noted that FIGS. 13A and 13B diagrammatically indicate that certain steps of the process are optional. The following steps are the optional steps: vacuumizing during pouch loading; reclosing the pouch after it has been initially opened in the steam tunnel by dunking the pouch into water, and thereafter opening the pouch for a second time in the steam chamber with the aid of a second jet of high pressure steam.

It all 13 steps diagrammatically illustrated in FIGS. 13A and 13B are performed, the headspace volume within each standard 5 inch × 7 inch pouch with a ⅜ inch seal was actually measured and is as indicated. In this regard, each flat pouch in the magazine 90 has an initial headspace of about 0.78 cc, the effect of applying a weight or squeezing force at step 2 by the pinch rolls 110,112 (FIG. 2) but without being vacuumized, reduces the headspace to about 0.26 cc. If the pouch is vacuumized at step 3 while being loaded into the conveyor 24 at step 4 its headspace is reduced to about 0.12 cc and retains this headspace until after entering the steam tunnel 128 at step 5 by virtue of the pouch clamping devices 44 tensioning the mouth of the pouch and forming a one-way valve therein that prevents air from entering the pouch.

When the pouch is opened at step 6, its headspace is increased to about 400 cc assuming that only enough steam is directed into the headspace to open the pouch. If additional steam is directed into the headspace this additional steam purges a steam-air mixture from the headspace thus reducing the amount of air therein. If the pouch is then collapsed either by mechanical means or by dunking it is hot water as indicated at step 7 in FIG. 13B and then returned into the steam chamber at step 8 its headspace is reduced to about 1 cc with most of the steam-air mixture in the headspace being purged therefrom thereby further reducing the amount of air retained in the pouch. The second opening of the pouch at step 9 again provides a primarily steam filled headspace of about 400 cc while the filling of a particulate product into the pouch at step 10 again reduces the headspace to a smaller amount, for example 250 cc, depending upon the type and quantity of product being filled into the pouch. The tracks 66,68 (FIG. 11) then cause the clamping devices 44 to apply a tensioning force at step 11 which closes the mouth of the filled pouch and reduces the headspace to about 38 cc. The pouch is then sealed within the steam tunnel 128 at step 12 retaining the approximate 38 cc headspace. Since most of this headspace is filled with steam, after the pouch has been discharged at step 13 and cooled thus condensing the steam the volume of gas remaining in the pouch is determined by the degree to which the product resists collapse of the pouch walls due to condensation of the steam within the pouch. These air volume measurements were conducted under standard condition at 68° F and are atmosphere of pressure.

As indicated in FIGS. 13A and 13B, the estimated amount of air remaining in the pouch when the pouch is acted upon only at steps 1, 4, 5 and 9–13 is as indicated in the line entitled AIR VOLUME-SIMPLEST. The data in this line indicates that the original headspace air (0.78cc) is retained in the pouch until the pouch is filled at step 10. Since the product entering the pouch at the filling station of step 10 is air-free and necessarily displaces a quantity of steam-air mixture of the pouch, the remaining quantity of air is estimated as being reduced to about 0.49 cc. During filling neither steam nor air-free gas was directed into the pouch when recording the disclosed air volume data. After the pouch has been closed at step 11 by applying a tensioning force to the mouth of the pouch which forces a steam-air mixture out of the mouth of the pouch, the volume of air remaining therein is reduced to an estimated 0.074 cc which remains in the pouch after sealing and cooling.

The line in FIG. 13A entitled AIR VOLUME—ALL STEPS indicates the estimated amount of air remaining in the pouch after each of the processing steps have been performed thereon. It will be noted that after the pouch has been sealed and cooled that an estimated infinitesimal amount of 0.00003 cc of air remains in the pouch.

It is, of course, well known that when a flexible container or pouch is sealed with steam in its headspace, that subsequent cooling of the pouch will condense the steam causing the pouch walls to collapse against the product therein with sufficient force to crush delicate products. If delicate products such as shoe string potatoes or potato chips are to be packaged, it is apparent that the pouch walls must not be allowed to crush the product. It will be understood that the shoe string potatoes have already been cooked and do not require any additional heat processing. Accordingly, it is a further feature of the invention to connect a source of noncondensible gas that is inert to the product being packaged, such as nitrogen or carbon dioxide, to the high pressure conduit 171 (FIG. 2) by a conduit 350 having a gas selector valve 352 therein. Thus, when handling such delicate products, a steam valve 354 in conduit 171 is turned off, and the selector valve 352 is turned on to direct a high pressure stream or jet of nitrogen (or another inert gas) into the pouches positioned between the opening station OS (FIG. 2) and the filling station FS through nozzle 170,178 and 179. This causes a large portion of the gas remaining in the headspace of each pouch after sealing to be a noncondensible inert gas thereby preventing condensation of steam to cause the pouch walls to collapse and crush the product. It is also apparent that the gas selector valve 352 and the steam valve 354 may both be partially opened to direct a mixture of steam and inert gas into the pouch thereby selectively controlling the degree of collapse of the pouch walls, after cooling, against the product.

If a product such as potato chips having very large voids between each article or chip is being handled, then the product itself may also be purged of air by directing the inert gas, rather than steam, at low pressure into the chamber 186 of the filling mechanism 84 (FIG. 6) through conduit 234 (FIG. 8). The particular inert gas must of course be lighter than air in order to purge the air from the product. Nitrogen is lighter than air and accordingly would be a suitable inert gas for excluding air from the product but should be heated to at least 212° F to reduce its density relative to air in the product and to prevent condensation of steam. It is well known that steam is a hot, condensible, non-drying, inexpensive, air-free gas.

From the foregoing description it is apparent that the air exclusion and pouch filling method forcibly flattens pouches to reduce the headspace to a minimum before moving the pouch into a steam tunnel and opening the pouch. During opening of the pouch a high pressure jet of either steam or a heavy inert gas such as carbon dioxide or cold nitrogen is directed into the headspace to assist opening and to prevent air from entering the headspace. The product to be filled into the pouches is also purged of air by causing either steam or a light inert gas to move upwardly in pockets of a filling mechanism thereby forcing the air to gravitate downwardly and out of the pocket leaving an air-free product for discharge into the open pouch. The pouch is subsequently sealed and if its headspace is filled with steam, the steam will condense upon cooling to cause the pouch walls to tightly grip the product. If the headspace of the pouch is filled with an inert gas, the pouch walls will loosely confine the product therein.

Although the best mode contemplated for carrying out the present invention has been herein shown and described, it will be apparent that modification and variation may be made without departing from what is regarded to be the subject matter of the invention.

What is claimed is:

1. A method of packaging a product in a substantially air-free pouch while moving the pouch through a plurality of processing stations in a tunnel comprising the steps of: receiving an empty pouch and maintaining the empty pouch closed, applying pressure to the pouch for flattening and squeezing headspace air out of the pouch, applying a vacuum about the pouch while pressure is being applied to the pouch to flatten the pouch, moving the closed pouch into the tunnel, maintaining an atmosphere of substantially air-free gas in the tunnel, opening the pouch when in said air-free atmosphere, filling the pouch with a product while in said air-free atmosphere, sealing the pouch when in said atmosphere, inducing said air-free gas to flow through the tunnel, and discharging the sealed pouch from said atomsphere.

2. A method of packaging a product in a substantially air-free pouch while moving the pouch through a plurality of processing stations in a tunnel comprising the steps of: receiving an empty pouch and maintaining the empty pouch closed, moving the closed pouch into the tunnel, maintaining an atmosphere of substantially air-free gas in the tunnel, opening the pouch when in said atmosphere, closing the pouch after it has been opened in said atmosphere by squeezing the side walls of the pouch together for purging a mixture of air and said air-free gas from the pouch, thereafter again opening the pouch in said atmosphere, filling the pouch while in said air-free atmosphere with a product, sealing the pouch when in said atmosphere, inducing said air-free gas to flow through the tunnel, and discharging the sealed pouch from said atmosphere.

3. A method according to claim 2 wherein the walls of the pouch are squeezed together by dunking the pouch in water.

4. A method of packaging a product in a substantially air-free pouch while moving the pouch through a plurality of processing stations in a tunnel comprising the steps of: receiving an empty pouch and maintaining the empty pouch closed, applying pressure to the pouch for flattening and squeezing headspace air out of the pouch, applying a vacuum about the pouch while pressure is being applied to the pouch to flatten the pouch, thereafter moving the closed pouch into the tunnel, maintaining an atmosphere of substantially air-free steam in the tunnel, opening the pouch when in said steam atmosphere, directing a jet of an air-free gas at superatmopheric pressure into the pouch to aid in opening the pouch and purging air therefrom, filling the pouch while in said steam atmosphere with a product, directing a jet of an air-free gas at superatmospheric pressure into the pouch during filling of the pouch, sealing the pouch when in said steam atmosphere, inducing said steam to flow through the tunnel, and discharging the sealed pouch from said steam atmosphere.

5. A method of packaging a product in a substantially air-free pouch while moving the pouch through a plurality of processing stations in a tunnel comprising the steps of: receiving an empty pouch and maintaining the empty pouch closed, moving the closed pouch into the tunnel, maintaining an atmosphere of substantially air-free steam in the tunnel, opening the pouch when in said atmosphere, directing a jet of an air-free gas at superatmospheric pressure ino the pouch to aid in opening the pouch and purging the air therefrom, closing the pouch after it has been opened in said atmosphere by squeezing the side walls of the pouch together for purging a steam-air mixture from the pouch, thereafter again opening the pouch in said atmosphere prior to filling the pouch, filling the pouch while in said air-free atmosphere with a product, directing a jet of an air-free gas at superatmospheric pressure into the pouch during filling of the pouch, sealing the pouch when in said atmosphere, inducing said air-free gas to flow through the tunnel, and discharging the sealed pouch from said atmosphere.

6. A method according to claim 5 wherein the product is a substantially air-free product.

* * * * *

UNITED STATES PATENT OFFICE

CERTIFICATE OF CORRECTION

Patent No. 4,027,456 Dated June 7, 1977

Inventor(s) Donald C. Wilson

It is certified that error appears in the above-identified patent and that said Letters Patent are hereby corrected as shown below:

Column 1, line 15, change "data" to --date--

Column 5, line 1, after "112" add --having--

Column 10, line 29, change "It" to --If--

Column 12, line 24, change "pocket" to --pockets--

Signed and Sealed this

*Ninth* Day of *September 1980*

[SEAL]

*Attest:*

SIDNEY A. DIAMOND

*Attesting Officer* *Commissioner of Patents and Trademarks*